US007237726B2

(12) United States Patent
Yu

(10) Patent No.: US 7,237,726 B2
(45) Date of Patent: Jul. 3, 2007

(54) PAINT SPRAYER GUN

(75) Inventor: Chang-Chieh Yu, Taichung County (TW)

(73) Assignee: PU Star Machinery Industrial Co., Ltd., Taichung (TW)

( * ) Notice: Subject to any disclaimer, the term of this patent is extended or adjusted under 35 U.S.C. 154(b) by 317 days.

(21) Appl. No.: 11/091,592

(22) Filed: Mar. 29, 2005

(65) Prior Publication Data

US 2006/0226258 A1 Oct. 12, 2006

(51) Int. Cl.

| | |
|---|---|
| ***B05B 1/28*** | (2006.01) |
| ***B05B 7/02*** | (2006.01) |
| ***B05B 7/06*** | (2006.01) |
| ***A62C 31/00*** | (2006.01) |
| ***F23D 11/16*** | (2006.01) |

(52) U.S. Cl. ..... 239/290; 239/291; 239/525; 239/526; 239/398; 239/429; 239/222.11; 239/222.13; 239/222.17; 239/223

(58) Field of Classification Search ..... 239/290, 239/291, 293, 461, 463, 483, 529, 526, 398, 239/399, 419.5, 429

See application file for complete search history.

(56) References Cited

U.S. PATENT DOCUMENTS

| | | | | |
|---|---|---|---|---|
| 3,802,511 | A * | 4/1974 | Good, Jr. | 169/30 |
| 4,993,642 | A * | 2/1991 | Hufgard | 239/300 |
| 5,165,604 | A * | 11/1992 | Copp, Jr. | 239/106 |
| 5,203,508 | A * | 4/1993 | Westenberger | 239/290 |
| 5,732,886 | A * | 3/1998 | Liaw | 239/526 |
| 6,758,418 | B2 * | 7/2004 | Romanin et al. | 239/537 |

* cited by examiner

*Primary Examiner*—Davis Hwu
(74) *Attorney, Agent, or Firm*—Bacon & Thomas, PLLC

(57) ABSTRACT

A paint sprayer gun includes a gun body set, an air-floating member set, which includes a tubular shaft suspending inside the gun body set, a sleeve fixedly mounted inside the gun body set around the tubular shaft and having through holes for guiding in compressed air to float the tubular shaft, and a driving wheel connected to the tubular shaft and rotatable with the tubular shaft upon compressed air, and a feeder, which is inserted through the tubular shaft for guiding paint fluid to a nozzle head at the front side of the gun body set for spraying over the workpiece and has a stop ring with an through hole fixedly fastened to the periphery thereof and stopped outside the gun body set for guiding in compressed air to the space within the tubular shaft outside the feeder to accelerate spraying of paint fluid.

8 Claims, 10 Drawing Sheets

PAINT SPRAYER GUN

BACKGROUND OF THE INVENTION

1. Field of the Invention

The present invention relates to a paint-coating apparatus and more particularly, to a paint sprayer gun.

2. Description of the Related Art

A conventional paint sprayer gun uses a ball bearing to move a diffuser plate, causing the diffuser plate to diffuse paint fluid into fine drops. During operation of this design of paint sprayer gun, the inner race and outer race of the ball bearing rub against each other to produce heat, thereby causing the surface of supplied paint fluid to become sticky. When sprayed paint fluid over the surface of the workpiece, small lumps may be formed on the coating, resulting in an uneven surface of the workpiece. Further, due to friction loss between the inner race and outer race of the ball bearing, the speed of rotation of the inner race will be reduced after a long use of the paint sprayer gun, affecting the formation of fine drops of paint fluid, i.e., this conventional design of paint sprayer gun wears quickly with use, resulting in a high maintenance cost.

SUMMARY OF THE INVENTION

The present invention has been accomplished under the circumstances in view. It is one objective of the present invention to provide a pain sprayer gun, which functions well for a long service time.

It is another objective of the present invention to provide a paint sprayer gun, which eliminates waste of paint fluid during application, thereby saving much material cost.

It is still another objective of the present invention to provide a paint sprayer gun, which forces paint fluid into fine molecules to form a fine coating on the surface of the workpiece.

To achieve these objectives of the present invention, the paint sprayer gun comprises a gun body set having a chamber, a first air inlet at the periphery thereof, a pivot hole and a second air inlet at a rear side thereof, the first air inlet and the second air inlet being adapted to guide in compressed air; an air-floating member set having a sleeve fixedly mounted inside the chamber of the gun body set, a tubular shaft rotatably inserted through the sleeve, and a driving wheel mounted inside the chamber of the gun body set and fixedly fastened to one end of the tubular shaft, the sleeve having a plurality of grooves arranged on the periphery thereof and intersected with one another and a plurality of through holes radially extending through the periphery in air communication with the grooves for guiding in compressed air from the second air inlet of the gun body set to float the tubular shaft, the tubular shaft having an axial passage extending through front and rear ends thereof, the driving wheel having a plurality of blades arranged around the periphery thereof for receiving compressed air from the second air inlet of the gun body set to cause the driving wheel to rotate; a feeder inserted through the pivot hole of the gun body set into the axial passage of the tubular shaft, the feeder having a fluid inlet disposed outside the gun body set and a fluid outlet suspending inside the gun body set, the feeder having a stop ring connected to the gun body set, the stop ring having a radial through hole in air communication with the annular guide groove in air communication with the pivot hole of the gun body set for guiding compressed air into the space inside the tubular shaft and outside the feeder; and a nozzle connected to the front end of the tubular shaft for spraying supplied paint fluid.

DETAILED DESCRIPTION OF THE INVENTION

Figure 1:
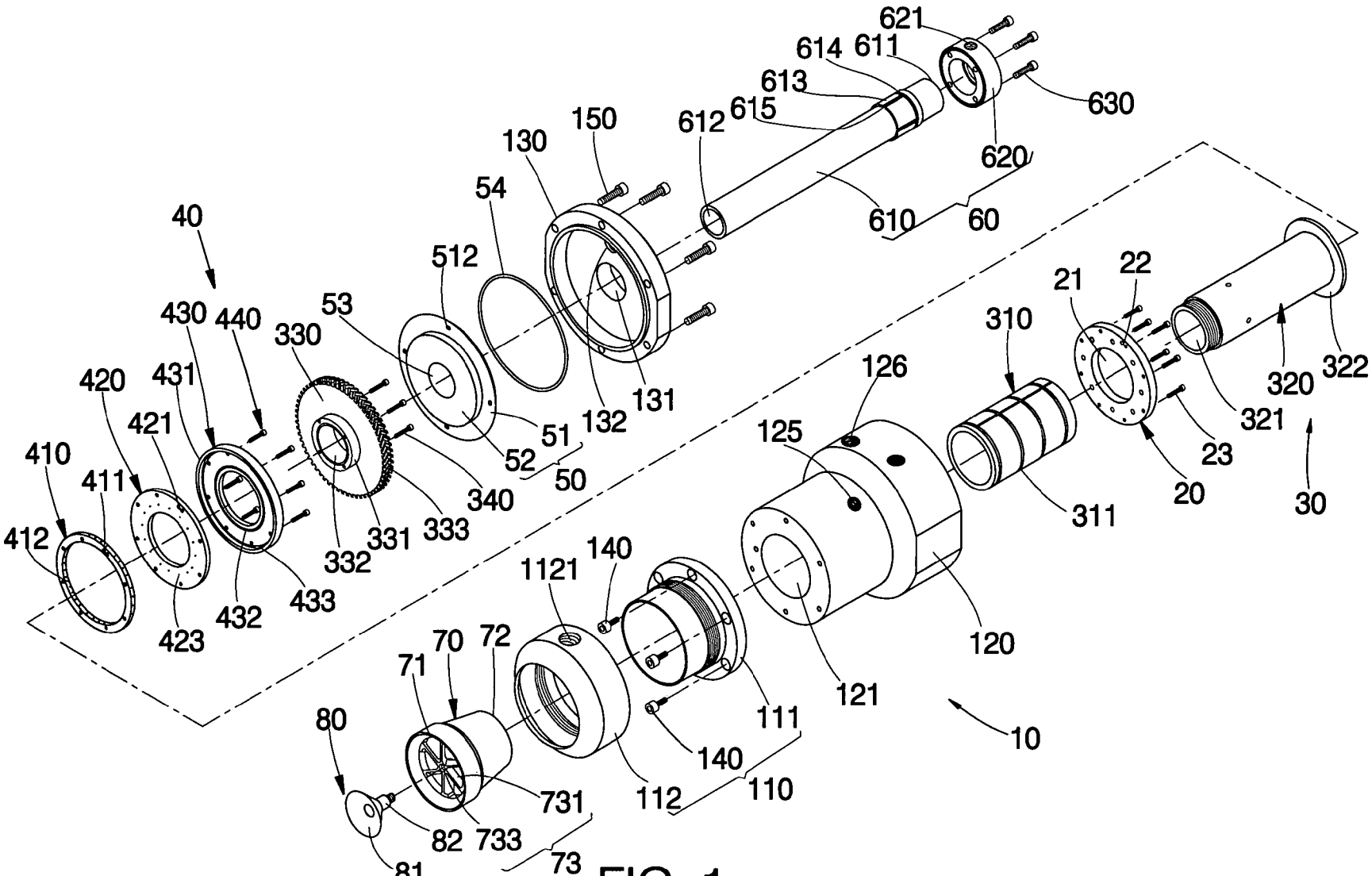
FIG. 1 is an exploded view of a paint sprayer gun according to a preferred embodiment of the present invention.
Figure 2:
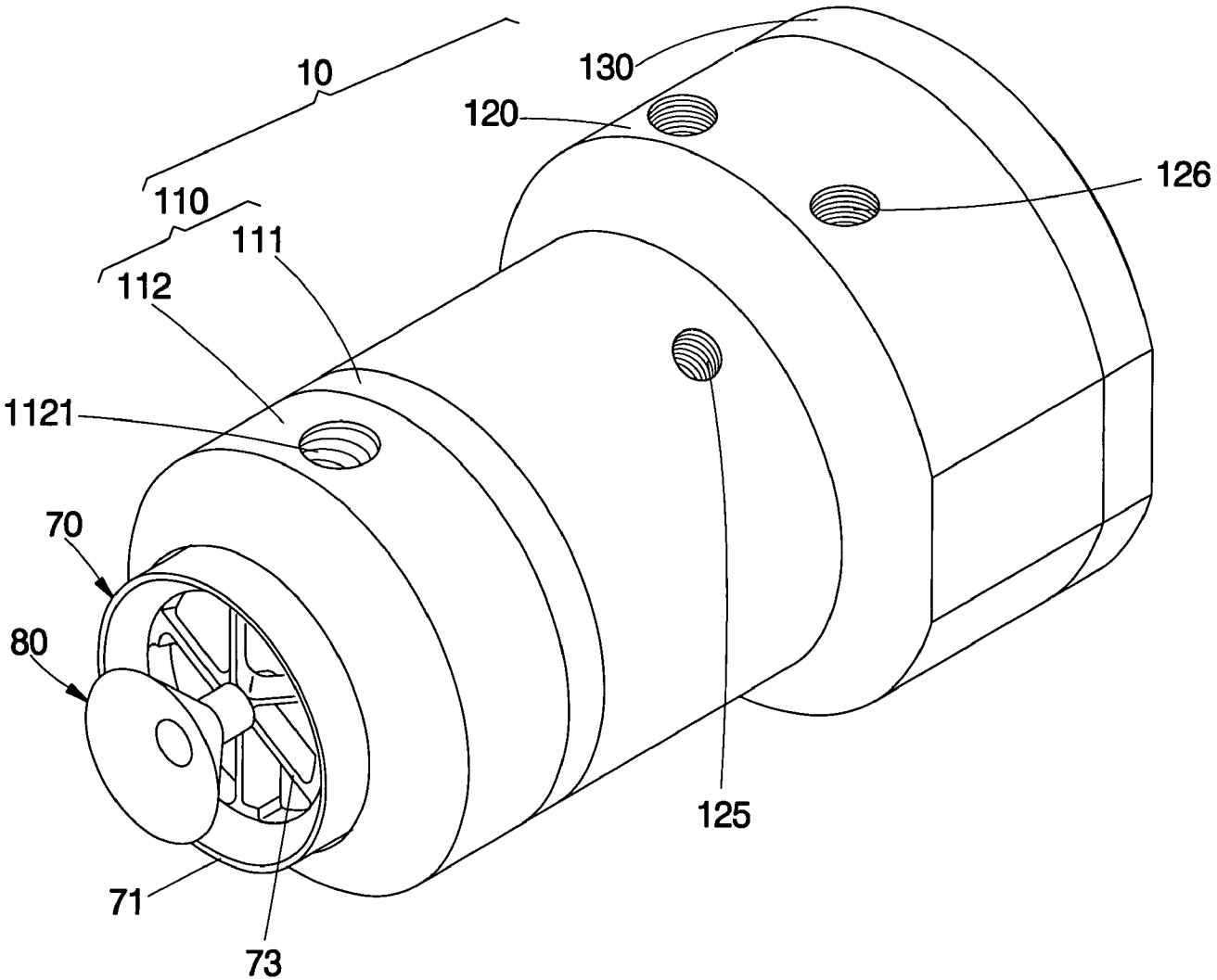
FIG. 2 is a perspective assembly view of the paint sprayer gun according to the preferred embodiment of the present invention.
Figure 3:
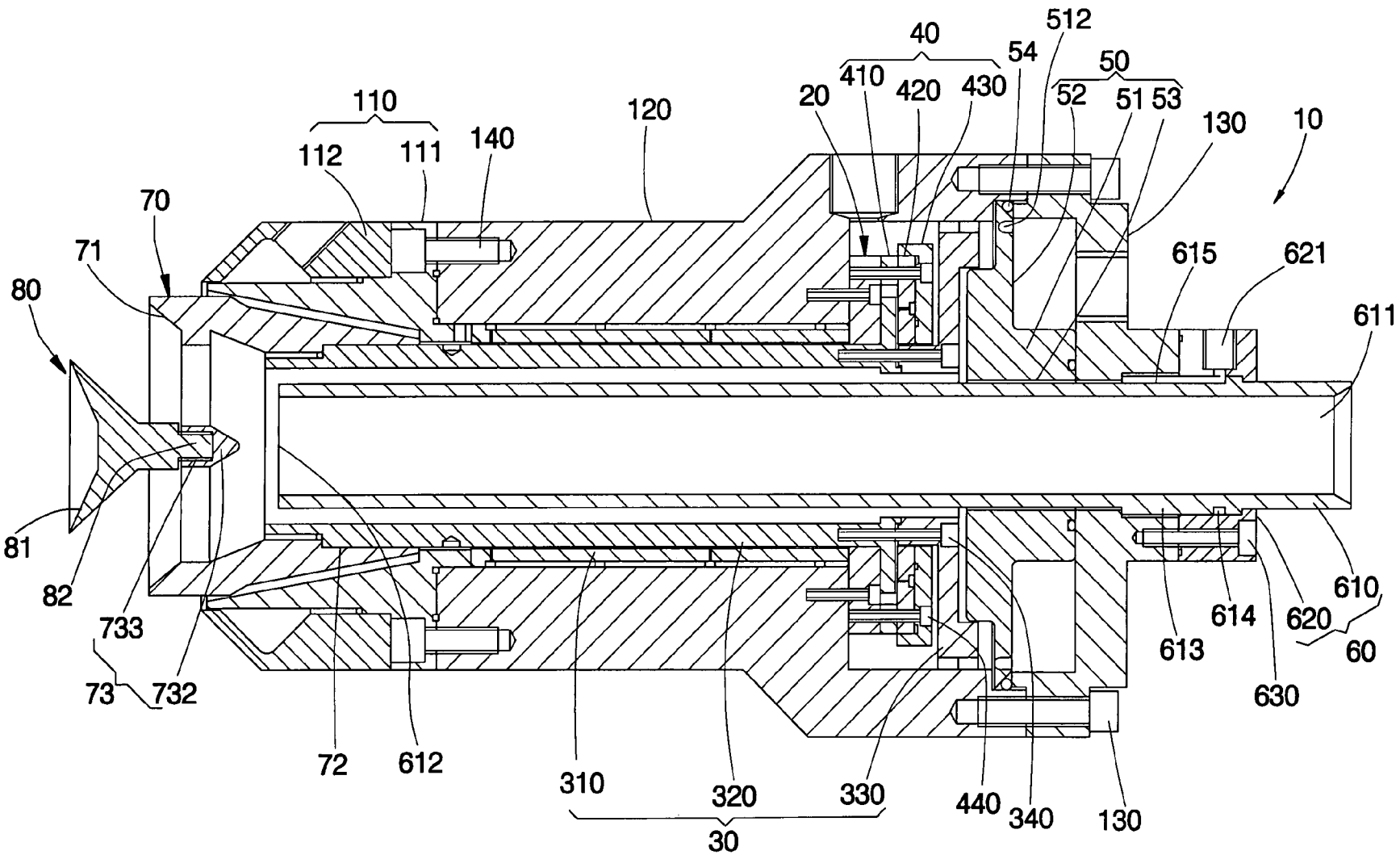
FIG. 3 is a sectional assembly view of the paint sprayer gun according to the preferred embodiment of the present invention.
Figure 4:
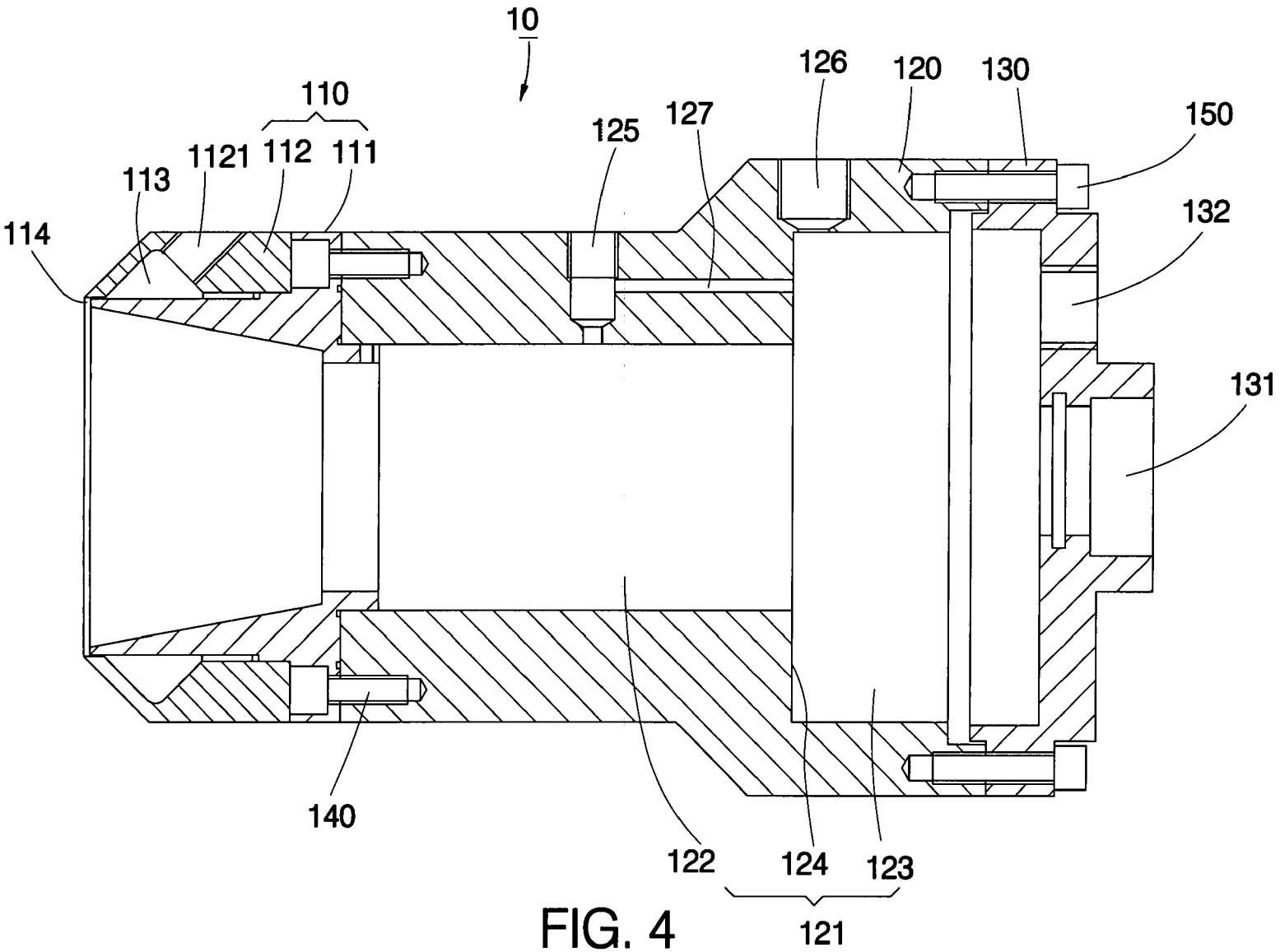
FIG. 4 is a sectional view of the body of the paint sprayer gun according to the preferred embodiment of the present invention.

Referring to FIGS. 1-4, a paint sprayer gun in accordance with the preferred embodiment of the present invention is shown comprised of a gun body set 10, an inside locating ring 20, an air-floating member set 30, a race unit 40, an air distributor 50, a tubular feeder 60, a nozzle head 70, and a diffuser plate 80.

The gun body set 10 is comprised of an air nozzle 110, a body 120, and a back cover 130. The air nozzle 110 comprises an inner nozzle element 111, and an outer nozzle element 112, which is sleeved onto the inner nozzle element 111 and defines with the inner nozzle element 111 a chamber 113 and an annular air gap 114 in air communication with the chamber 113. The outer nozzle element 112 has an opening 1121 for guiding compressed air into the chamber 113. The body 120 is shaped like a stepped tube, having the front side thereof fixedly fastened to the rear side of the inner nozzle element 111 with screws 140, a stepped cylindrical chamber 121 longitudinally extending through the front and rear sides thereof and formed of a small diameter portion 122 and a big diameter portion 123 and a shoulder 124 between the small diameter portion 122 and the big diameter portion 123, an air inlet 125, namely the first air inlet, in air communication with the small diameter portion 122 of the stepped cylindrical chamber 121, four air outlets 126 in air communication with the big diameter portion 123 of the stepped cylindrical chamber 121, and an through hole 127 extending through the shoulder 124 in air communication between the air inlet 125 and the big diameter portion 123 of the stepped cylindrical chamber 121. The back cover 130 is fixedly fastened to the rear side of the body 120 with screws 150 to block the open end of the big diameter portion 123 of the stepped cylindrical chamber 121, having a center pivot hole 131 and an air inlet 132, namely the second air inlet, adjacent to the center pivot hole 131. The center pivot hole 131 and the air inlet 132 extend the front and back sides of the back cover 130 in communication with the big diameter portion 123 of the stepped cylindrical chamber 121.

The inside locating ring 20 is located inside the big diameter portion 123 of the stepped cylindrical chamber 121 of the body 120 and fixedly fastened to the shoulder 124 with screws 23, having a center opening 21 corresponding to the small diameter portion 122 of the stepped cylindrical chamber 121 of the body 120 and a through hole 22 in air communication between the through hole 127 and the big diameter portion 123 of the stepped cylindrical chamber 121 of the body 120.

Figure 5:
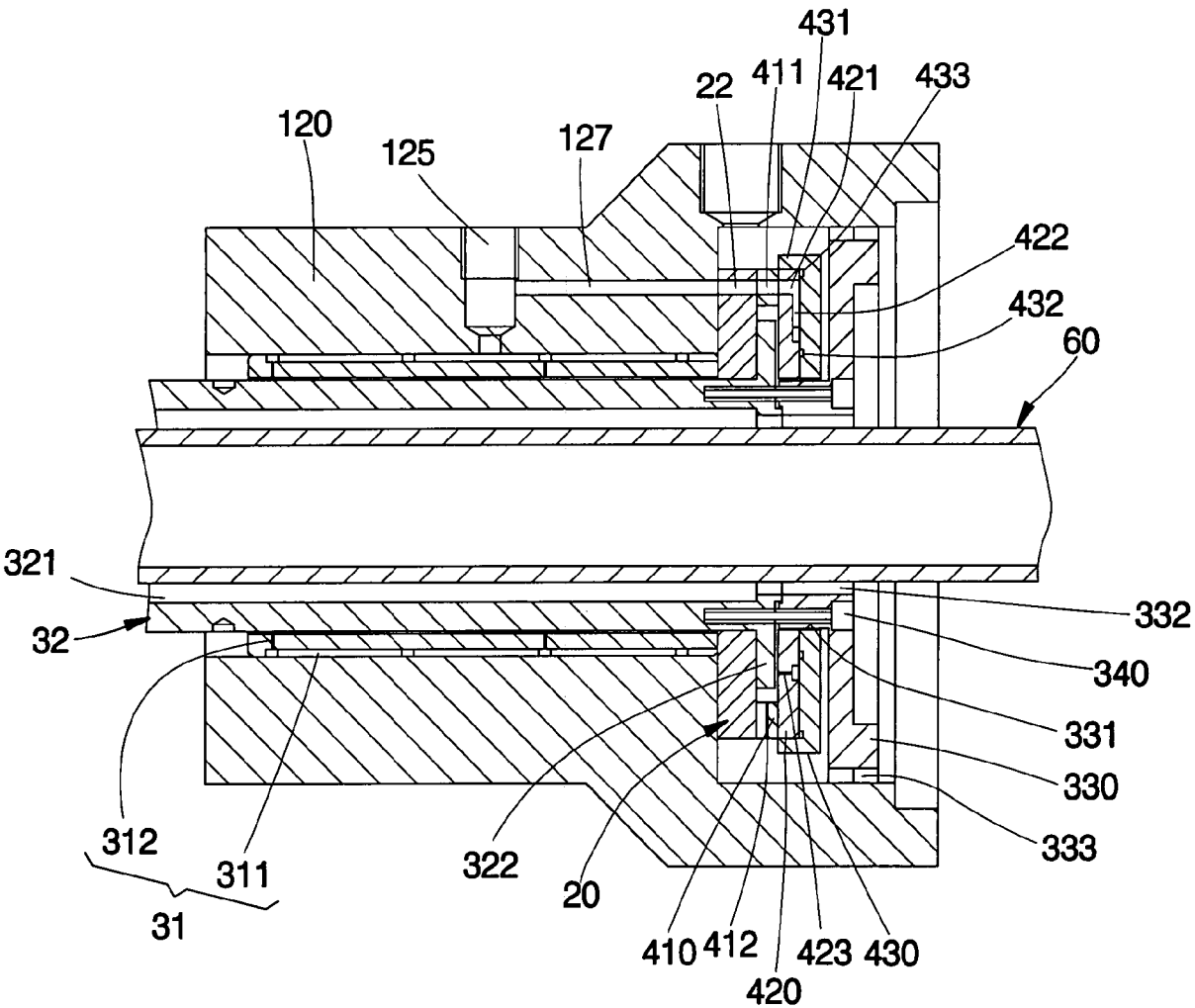
FIG. 5 is a sectional view of a part of the present invention, showing positioning of the air-floating member set and the race unit in the gun body set.

Referring to FIG. 5 and FIGS. 1 and 3 again, the air-floating member set 30 comprises a sleeve 310, a tubular shaft 320, and a driving wheel 330. The sleeve 310 is fixedly mounted inside the small diameter portion 122 of the stepped cylindrical chamber 121 of the body 120, having a plurality of grooves 311 arranged on the periphery and intersected with one another and a plurality of through holes 312 radially extending through the periphery thereof in air communication with the grooves 311. The tubular shaft 320 is rotatably inserted through the sleeve 310, having a stop flange 322 outwardly extending around the rear side thereof and stopped at the back side of the inside locating ring 20 and an axial passage 321 extending through the front and rear sides thereof. The driving wheel 330 is mounted inside the big diameter portion 123 of the stepped cylindrical chamber 121 of the body 120, having a hub 331 projecting into the smaller diameter portion 122 of the stepped cylindrical chamber 121 of the body 120 and fixedly fastened to the rear side of the tubular shaft 320 with screws 340, a center through hole 332 axially extending through the hub 331 in communication with the axial passage 321 of the tubular shaft 320, and a plurality of blades 333 arranged around the periphery and shaped like teeth of a double helical gear when viewing from one lateral side thereof.

Referring to FIGS. 1, 3 and 5 again, the race unit 40 comprises a first race 410, a second race 420, and a third race 430. The first race first race 410, the second race 420 and the third race 430 are arranged in a stack between the inside locating ring 20 and the driving wheel 330 of the air-floating member set 30 and fixedly fastened to the inside locating ring 20. The first race 410 has a guide hole 411 corresponding to the through hole 22 of the inside locating ring 20 and a plurality of through holes 412. The second race 420 has a through hole 421 corresponding to the guide hole 411 of the first race 410, an annular groove 422 disposed at the back side thereof and facing the third race 430, and a plurality of through holes 423 extending through the annular groove 422 corresponding to the stop flange 322 of the tubular shaft 320. The third race 430 is shaped like a cap, having a sidewall 431 surrounding the periphery of the second race 420. Further, gasket rings 432 and 433 are fastened to the third race 430 and respectively stopped against the second race 420 around the inner and outer sides of the annular groove 422.

Referring to FIGS. 1 and 3 again, the air distributor 50 is mounted inside the big diameter portion 123 of the stepped cylindrical chamber 121 of the body 120, comprising a circular flat base 51, a circular protrusion 52 protruded from one side of the circular flat base 51, a center through hole 53 extending through the center of the circular protrusion 52 and the circular flat base 51, and four border through holes 512 extending through the circular flat base 51 and equiangularly spaced around the circular protrusion 52. The circular protrusion 52 is closely attached to the inside locating ring 130. The circular flat base 51 is set corresponding to the air inlet 132 of the back cover 130. The through holes 512 are spirally extending through the circular flat base 51 in the same direction. Further, a gasket ring 54 is fastened to the circular protrusion 52 around the center through hole 53 and closely attached to the peripheral wall of the big diameter portion 123 of the stepped cylindrical chamber 121 of the body 120 to seal the gap.

Referring to FIGS. 1 and 3 again, the feeder 60 is comprised of a tubular member 610 and a stop ring 620. The tubular member 610 is freely inserted through the pivot hole 131 of the back cover 130, the center through hole 53 of the air distributor 50 and the center through hole 332 of the driving wheel 330, having a rear end forming a fluid inlet 611, a front end forming a fluid outlet 612 for the passing of supplied paint fluid, a collar 613 extending around the periphery near the fluid inlet 611 and partially inserted into the pivot hole 131 of the back cover 130, an annular guide groove 614 extending around the collar 613 near the fluid inlet 611 and disposed outside the pivot hole 131 of the back cover 130, and a plurality of shunt grooves 615 respectively axially extending from the annular guide groove 614 and set in communication with the pivot hole 131 of the back cover 130 and the center through hole 53 of the air distributor 50. The stop ring 620 is sleeved onto a part of the collar 613 of the tubular member 610 and fixedly fastened to the back cover 130 with screws 630, having a radial through hole 621 in air communication with the annular guide groove 614 for guiding compressed air into the annular guide groove 614.

Referring to FIGS. 1-3 again, the nozzle head 70 is shaped like a conical tube mounted inside the inner nozzle element 111 of the air nozzle 110, having a relatively bigger front output side 71, a relatively smaller rear input side 72 connected to the free (front) end of the tubular shaft 320, and a vane wheel 73 mounted within the front output side 71. The vane wheel 73 comprises a plurality of radially spirally extending vanes 731, a rear projection 732 protruded from the back side thereof at the center and facing the rear input side 72 of the nozzle had 70, and a front recess 733 provided at the center of the front side thereof.

Referring to FIGS. 1-3 again, the diffuser plate 80 is provided at the front side of the nozzle head 70, comprising an inwardly curved plate body 81 and a stem 82 backwardly extended from the center of the back side of the inwardly curved plate body 81 and fixedly fastened to the front recess 733 of the vane wheel 73.

Figure 6:
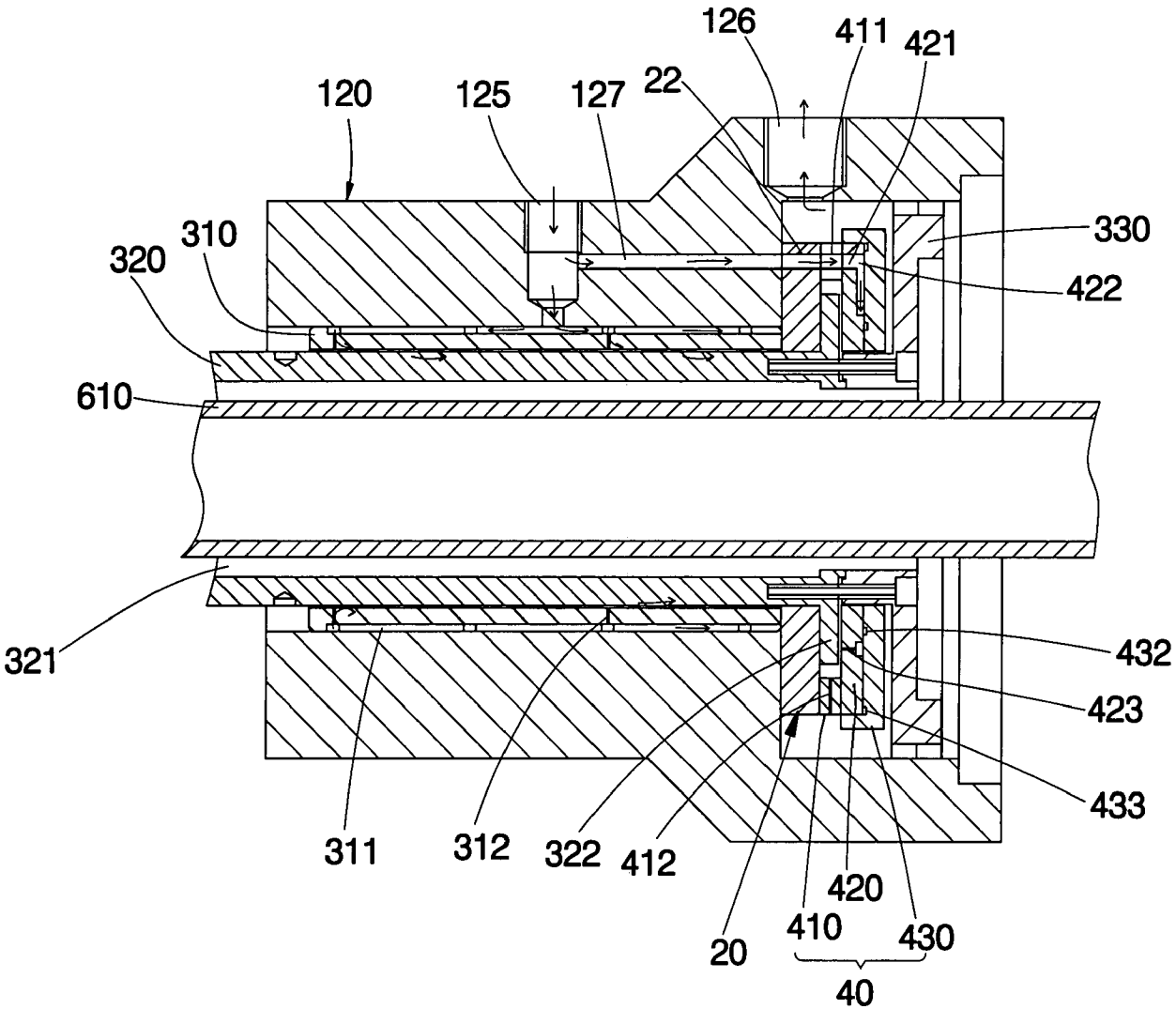
FIG. 6 is similar to FIG. 5 but showing compressed air is guided into the air inlet of the gun body set.
Figure 7:
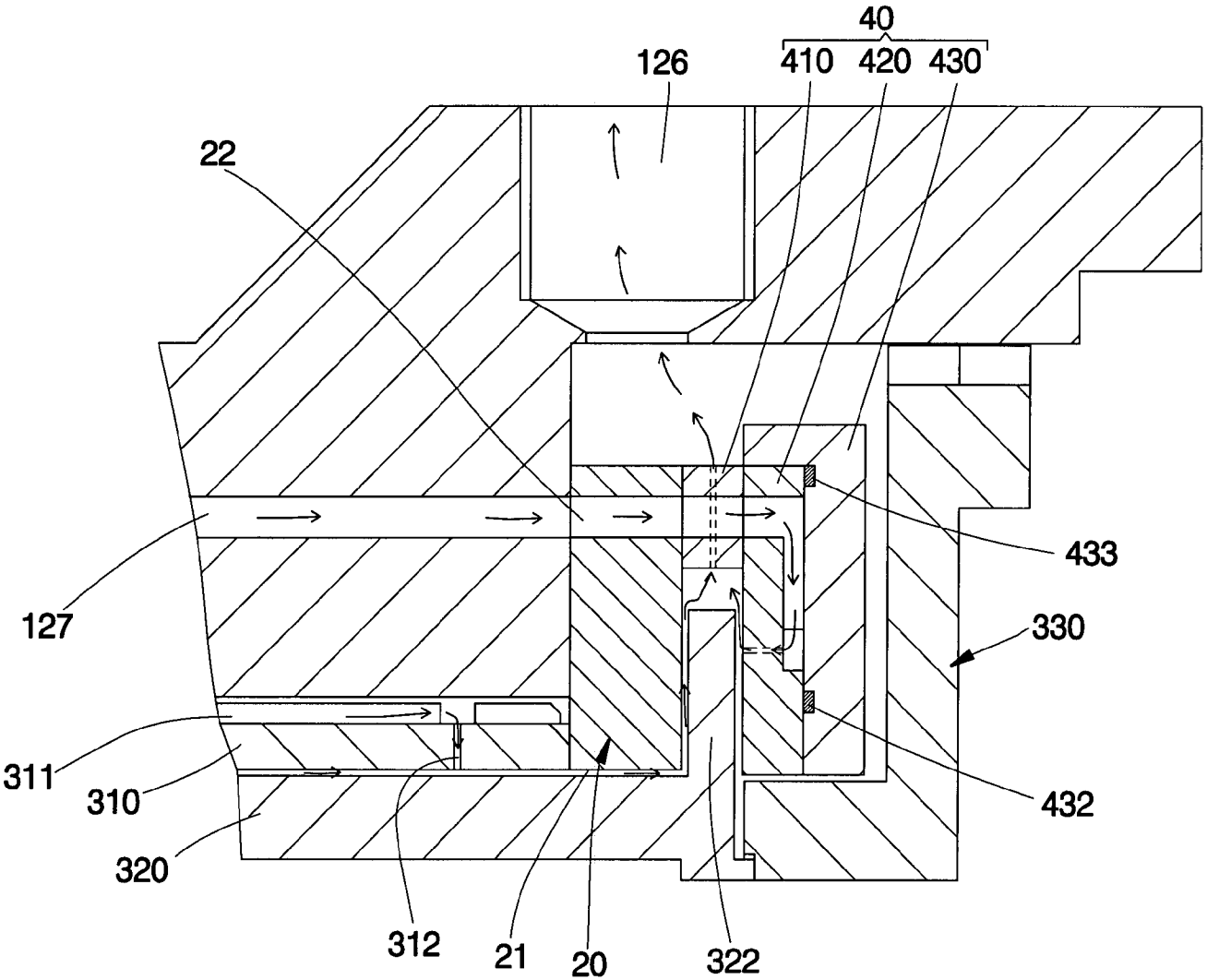
FIG. 7 is an enlarged view of a part of FIG. 6.
Figure 8:
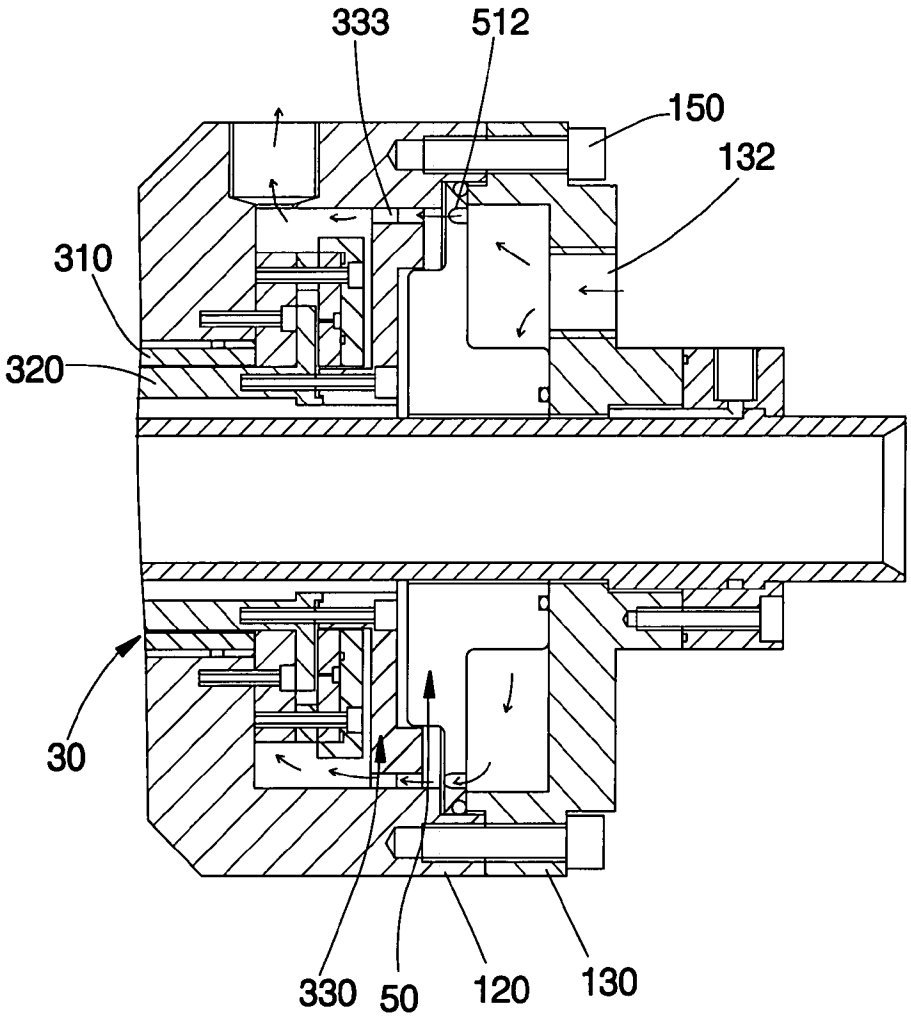
FIG. 8 is a schematic drawing of the present invention, showing compressed air is guided into the air inlet of the back cover.

Referring to FIGS. 6 through 8, when using the paint sprayer gun, the prepared paint fluid is filled into the fluid inlet 611 of the feeder 60, and compressed air is guided into the radial through hole 621 of the stop ring 620, the air inlet 132 of the back cover 130, the opening 1121 of the air nozzle 110, and the air inlet 125 of the body 120 of the gun body set 10.

At first, compressed air passes from the air inlet 125 of the body 120 of the gun body set 10 through the grooves 311 and through holes 312 of the sleeve 310 toward the periphery of the tubular shaft 320, thereby floating the tubular shaft 320 inside the sleeve 310 (see FIG. 7). At this time, compressed air moves along the gap between the inside wall of the sleeve 310 and the outside wall of the tubular shaft 320 to push the stop flange 322 toward the race set 40. In order to prevent friction between the stop flange 322 and the second race 420, the design of the present invention enables compressed air to be guided from the air inlet 125 of the body 120 into the through hole 22 of the inside locating ring 20, the guide hole 411 of the first race 410 and the through hole 421 of the second race 420, and then into the annular groove 422 of the second race 420. By means of the sealing effect of the gasket rings 432 and 433, compressed air is forced to pass through the through hole 423 of the second race 420 to push the stop flange 322 of the tubular shaft 320 in the reversed direction, thereby keeping the tubular shaft 320 in balance. At the same time, the excessive part of compressed air passes over the stop flange 322 of the tubular shaft 320 to the outside of the gun body set 10 through the through hole 412 of the first race 410 via the air outlets 126 of the body 120.

As shown in FIG. 8, compressed air that passes through the air inlet 132 of the back cover 130 will first be accumulated in the space between the back cover 130 and the air distributor 50. When the pressure of accumulated air surpassed a predetermined level, compressed air immediately passes away from the space between the back cover 130 and the air distributor 50 into the spirally extending border through holes 512 of the air distributor 50, therefore forming evenly distributed and spirally moving flows of compressed air. The evenly distributed and spirally moving flows of compressed air will then pass over the blades 333 of the driving wheel 330 and separated by the blades 333 evenly, thereby causing the driving wheel 330 to rotate the floating tubular shaft 320 and the nozzle head 70 at a high speed. Therefore, when paint fluid flows from the fluid inlet 611 to the vane wheel 73 of the nozzle head 70, the radially spirally extending vanes 731 will cut pain fluid into fine drops, enabling the fine drops of paint fluid to be further diffused by the inwardly curved plate body 81 of the diffuser plate 80 into fine molecules. At the same time, after forcing the driving wheel 330 to rotate, compressed air passes to the outside of the paint sprayer gun through the air outlets 126 of the body 120 of the gun body set 10.

Figure 9:
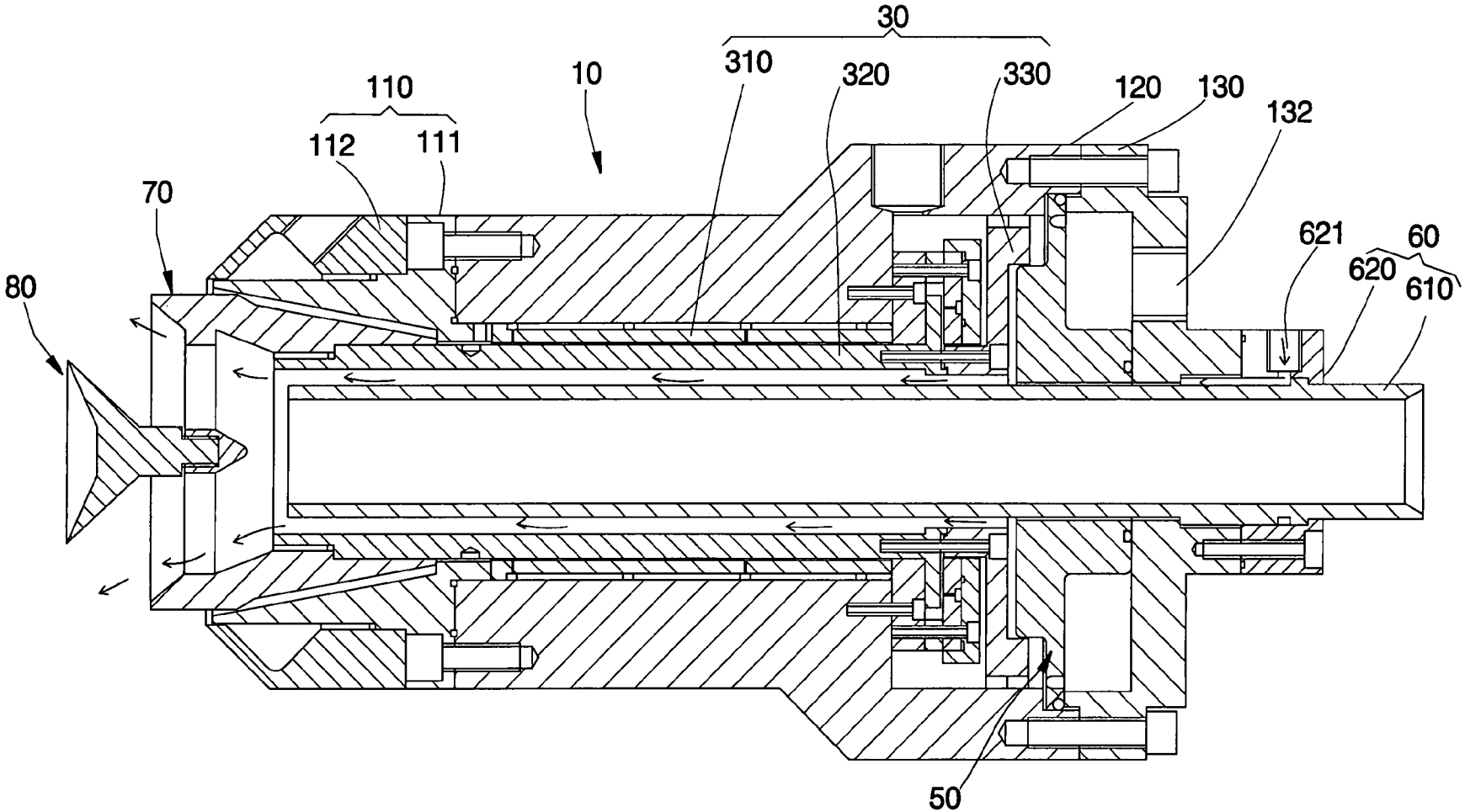
FIG. 9 is a schematic drawing of the present invention, showing compressed air is guided into the radial through hole of the feeder.

Referring to FIG. 9, after entered the radial through hole 621 of the feeder 60, compressed air passes through the pivot hole 131 of the back cover 130, the center through hole 53 of the air distributor 50 and the center through hole 332 of the driving wheel 330 into the space between the inside wall of the tubular shaft 320 and the outside wall of the tubular member 610, and then moves at a high speed toward the nozzle head 70 to force supplied paint fluid out of the nozzle head 70, preventing adhesion of supplied paint fluid to the inside wall of the nozzle head 70 or accumulation of paint fluid in the inside wall of the tubular shaft 320.

Figure 10:
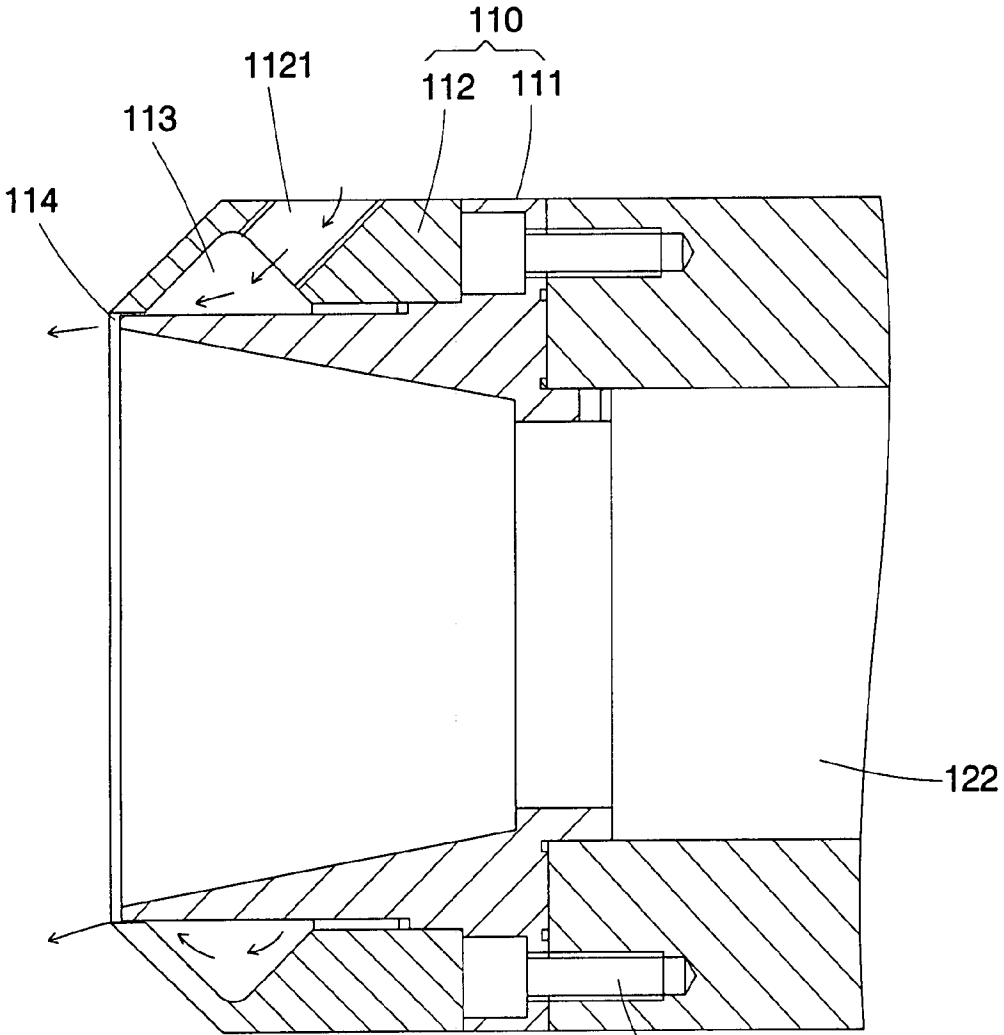
FIG. 10 is a schematic drawing of the present invention, showing compressed air is guided into the opening of the outer nozzle element of the gun body set.

Referring to FIG. 10, compressed air that is guided through the opening 1121 of the outer nozzle element 112 into the chamber 113 will be accumulated in the chamber 113. When compressed air reaches a certain pressure level in the chamber 113, it will rush out of the air gap 114 to form an annular wall of air that constrains the spraying of fine drops of paint fluid to a certain area, preventing waste of paint fluid.

As indicated above, the invention has the following advantages:

1. By means of the radial through hole of the feeder to guide in compressed air, compressed air is used to clean the floating tubular shaft and the nozzle head during application, so that the tubular shaft functions well for a long service time and paint fluid can be forced out of the nozzle head at a high speed to produce a fine spray of paint fluid, forming a fine coating on the surface of the workpiece.

2. Compressed air is employed to float and rotate the tubular shaft without friction, thereby accelerating the speed of rotation of the nozzle head to produce a fine spray of paint fluid.

Further, it is recommended that the contained angle between the radially spirally extending vanes and the axis of the vane wheel is set within 45°-90°.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A paint sprayer gun comprising:

a gun body set having a chamber, a first air inlet at a periphery thereof, a pivot hole and a second air inlet at a rear side thereof, said first air inlet and said second air inlet being for guiding in compressed air;

an air-floating member set having a sleeve fixedly mounted inside the chamber of said gun body set, a tubular shaft rotatably inserted through said sleeve, and a driving wheel located inside the chamber of said gun body set and fixedly fastened to one end of said tubular shaft, said sleeve having a plurality of grooves arranged on a periphery thereof and intersected with one another and a plurality of through holes radially extending through the periphery in air communication with said grooves for guiding in compressed air from the second air inlet of said gun body set to float said tubular shaft, said tubular shaft having an axial passage extending through front and rear ends thereof, said driving wheel having a plurality of blades arranged around a periphery thereof for receiving compressed air from the second air inlet of said gun body set to cause said tubular shaft to be rotated along with the rotation of said driving wheel;

a tubular feeder inserted through the pivot hole of said gun body set into the axial passage of said tubular shaft, said feeder having a fluid inlet disposed outside said gun body set and a fluid outlet suspending inside said gun body set, said feeder having a stop ring connected to said gun body set, said stop ring having a radial through hole in air communication with said pivot hole of said gun body set for guiding compressed air into a space inside said tubular shaft and outside said feeder; and a nozzle connected to a front end of said tubular shaft for spraying supplied paint fluid.

2. The paint sprayer gun as claimed in claim 1, wherein said feeder is comprised of a tubular member and said stop ring, said tubular member having a collar extending around a periphery thereof and partially inserted into the pivot hole of said gun body set, an annular guide groove extending around said collar, and a plurality of shunt grooves respectively axially extending from said annular guide groove and set in communication with the pivot hole of said gun body set.

3. The paint sprayer gun as claimed in claim 1, wherein said gun body set comprises a body and a back cover, said body being a stepped tube defining said chamber of said gun body set, said chamber having a small diameter portion disposed in air communication with said first air inlet for accommodating said sleeve of said air-floating member set, a big diameter portion for accommodating said driving wheel of said air-floating member set, and a shoulder between said small diameter portion and said big diameter portion, said back cover blocking said big diameter portion and defining said pivot hole and said second air inlet of said gun body set.

4. The paint sprayer gun as claimed in claim 3, further comprising an air distributor mounted inside the big diameter portion of said chamber of said gun body and located between the driving wheel of said air-floating member set and the back cover of said gun body set, and a gasket ring fastened to said air distributor, said air distributor having a circular flat base, a circular protrusion protruded from one side of said circular flat base, a center through hole extending through the center of said circular protrusion and said circular flat base, and a plurality of border spirally extending through holes extending through said circular flat base in same direction and equiangularly spaced around said circular protrusion, said gasket ring being fastened to said circular protrusion and closely attached to said body of said gun body set around said big diameter portion.

5. The paint sprayer gun as claimed in claim 3, wherein said gun body set further comprises an air nozzle having an inner nozzle element mounted in said small diameter portion of said chamber of said gun body set, and an outer nozzle element sleeved onto said inner nozzle element, said outer nozzle element defining with said inner nozzle element an air chamber and an annular air gap in air communication with the air chamber, said outer nozzle element having an opening for guiding compressed air into the air chamber.

6. The paint sprayer gun as claimed in claim 5, wherein said nozzle head is a conical tube mounted inside the inner nozzle element of said air nozzle, having a relatively bigger front output side, a relatively smaller rear input side connected to said tubular shaft, and a vane wheel mounted within said front output side, said vane wheel comprising a plurality of radially spirally extending vanes.

7. The paint sprayer gun as claimed in claim 6, further comprising a diffuser plate having an inwardly curved plate body and a stem backwardly extended from said inwardly curved plate body and fixedly fastened to a front recess at said vane wheel.

8. The paint sprayer gun as claimed in claim 7, wherein said radially spirally extending vanes define with the axis of said vane wheel a contained angle within 45°-90°.

* * * * *